US011849871B2

(12) United States Patent
Michaels et al.

(10) Patent No.: US 11,849,871 B2
(45) Date of Patent: Dec. 26, 2023

(54) SIPPY CUP

(71) Applicant: B.BOX FOR KIDS DEVELOPMENTS PTY LTD, Mulgrave (AU)

(72) Inventors: Dannielle Lisa Michaels, Mulgrave (AU); Monique Miriam Filer, Mulgrave (AU)

(73) Assignee: B.BOX FOR KIDS DEVELOPMENTS PTY LTD, Mulgrave (AU)

( * ) Notice: Subject to any disclaimer, the term of this patent is extended or adjusted under 35 U.S.C. 154(b) by 0 days.

(21) Appl. No.: 17/676,345

(22) Filed: Feb. 21, 2022

(65) Prior Publication Data

US 2022/0167767 A1 Jun. 2, 2022

Related U.S. Application Data

(63) Continuation of application No. 16/614,941, filed as application No. PCT/IB2017/053532 on Jun. 14, 2017, now Pat. No. 11,284,730.

(51) Int. Cl.

| | |
|---|---|
| ***A47G 19/22*** | (2006.01) |
| ***B65D 47/06*** | (2006.01) |
| ***B65D 47/32*** | (2006.01) |

(52) U.S. Cl.

CPC ..... *A47G 19/2272* (2013.01); *B65D 47/066* (2013.01); *B65D 47/32* (2013.01)

(58) Field of Classification Search

CPC ... A47G 19/2272; B65D 47/066; B65D 47/32

(Continued)

(56) References Cited

U.S. PATENT DOCUMENTS

| | | | |
|---|---|---|---|
| 3,710,419 | A | 1/1973 | De Groft |
| 5,409,131 | A | 4/1995 | Phillips et al. |

(Continued)

FOREIGN PATENT DOCUMENTS

| | | | |
|---|---|---|---|
| CN | 201472895 | U | 5/2010 |
| CN | 102525223 | A | 7/2012 |

(Continued)

OTHER PUBLICATIONS

International search Report prepared by the Australian Patent Office for PCT/IB2017/053532, dated Jul. 26, 2017, 3 pages.

*Primary Examiner* — J. Gregory Pickett
*Assistant Examiner* — Niki M Eloshway
(74) *Attorney, Agent, or Firm* — BROOKS KUSHMAN PC; John E. Nemazi

(57) ABSTRACT

A drinking vessel having a cup with a removable lid having an inlet-outlet opening which receives an elastic straw-vent assembly having a flexible tubular straw and an air passageway forming a vent opening. A cover movably mounted on top of the lid, shiftable between a closed and an open position, with an inward surface of the cover forming fluid tight seal with the vent opening when the cover is in the closed position. In the closed position the cover engages the straw, folding the straw against the lid to seal the straw passageway, and in the open position, the straw fluid passageway and the vent opening are unobstructed by the cover. A removeable elastic straw-vent assembly is also disclosed having a tab to be grasped by the user for easy removal for cleaning.

15 Claims, 12 Drawing Sheets

(58) Field of Classification Search
USPC ..... 220/212.5
See application file for complete search history.

(56) References Cited

U.S. PATENT DOCUMENTS

| | | | |
|---|---|---|---|
| 5,890,620 | A | 4/1999 | Belcastro |
| 6,116,458 | A | 9/2000 | Dark |
| 7,533,783 | B2 | 5/2009 | Choi et al. |
| 8,191,727 | B2 | 6/2012 | Davies et al. |
| 8,336,724 | B2 | 12/2012 | Yamashita et al. |
| 8,376,165 | B2 | 2/2013 | Chiang |
| 8,376,173 | B2 | 2/2013 | Britto et al. |
| 8,469,226 | B2 | 6/2013 | Davies et al. |
| 8,622,236 | B2 | 1/2014 | Sanbrook et al. |
| 8,622,237 | B2 | 1/2014 | Choi et al. |
| 8,777,048 | B2 | 7/2014 | Choi et al. |
| 9,220,360 | B2 | 12/2015 | Arai et al. |
| 9,463,911 | B2 | 10/2016 | Choi et al. |
| 9,782,028 | B2 | 10/2017 | Davies et al. |
| 9,790,007 | B2 | 10/2017 | Sorensen et al. |
| 9,820,595 | B2 | 11/2017 | Davies et al. |
| 10,023,365 | B2 | 7/2018 | Choi et al. |
| 10,117,533 | B2 | 11/2018 | Chen et al. |
| 10,159,368 | B2 | 12/2018 | Lin |
| 10,165,879 | B2 | 1/2019 | Davies et al. |
| 10,214,328 | B2 | 2/2019 | Sorensen et al. |
| 10,214,330 | B2 | 2/2019 | Leimone et al. |
| 10,399,745 | B2 | 9/2019 | Fang |
| 10,455,959 | B2 | 10/2019 | Coon et al. |
| 10,542,833 | B2 | 1/2020 | Davies et al. |
| 10,676,255 | B2 | 6/2020 | Choi et al. |
| 10,687,643 | B2 | 6/2020 | Cheng |
| 10,835,065 | B2 | 11/2020 | Löhn et al. |
| 10,865,020 | B2 | 12/2020 | Herling et al. |
| 10,870,521 | B2 | 12/2020 | Fang |
| 10,993,563 | B2 | 5/2021 | Davies et al. |
| 11,242,178 | B2 | 2/2022 | Choi et al. |
| 2002/0040906 | A1 | 4/2002 | Hakim |
| 2006/0201952 | A1 | 9/2006 | Hakim |
| 2006/0226110 | A1 | 10/2006 | Choi et al. |
| 2007/0039959 | A1 | 2/2007 | Choi et al. |
| 2008/0237233 | A1 | 10/2008 | Choi et al. |
| 2009/0255944 | A1 | 10/2009 | Yamashita et al. |
| 2010/0127005 | A1 | 5/2010 | Sanbrook et al. |
| 2010/0170902 | A1 | 7/2010 | Britto et al. |
| 2010/0181329 | A1 | 7/2010 | Davies et al. |
| 2012/0160851 | A1 | 6/2012 | Chiang |
| 2012/0228315 | A1 | 9/2012 | Davies et al. |
| 2013/0008902 | A1 | 1/2013 | Davies et al. |
| 2014/0166679 | A1 | 6/2014 | Arai et al. |
| 2014/0319183 | A1 | 10/2014 | Choi et al. |
| 2017/0021982 | A1 | 1/2017 | Choi et al. |
| 2017/0112310 | A1 | 4/2017 | Davies et al. |
| 2017/0144809 | A1 | 5/2017 | Sorensen et al. |
| 2017/0190481 | A1 | 7/2017 | Leimone et al. |
| 2017/0283132 | A1 | 10/2017 | Sorensen et al. |
| 2017/0340148 | A1* | 11/2017 | Chen ..... A47G 21/18 |
| 2017/0354279 | A1 | 12/2017 | Löhn et al. |
| 2018/0050847 | A1 | 2/2018 | Herling |
| 2018/0070751 | A1 | 3/2018 | Davies et al. |
| 2018/0192800 | A1 | 7/2018 | Coon et al. |
| 2018/0208366 | A1 | 7/2018 | Fang |
| 2018/0327151 | A1 | 11/2018 | Choi et al. |
| 2018/0332987 | A1 | 11/2018 | Lin |
| 2019/0133355 | A1 | 5/2019 | Davies et al. |
| 2019/0161251 | A1 | 5/2019 | Fang |
| 2019/0263572 | A1 | 8/2019 | Keung |
| 2020/0002063 | A1 | 1/2020 | Sorensen et al. |
| 2020/0093305 | A1* | 3/2020 | Cheng ..... A47G 19/2266 |
| 2020/0121105 | A1 | 4/2020 | Davies et al. |

FOREIGN PATENT DOCUMENTS

| | | | |
|---|---|---|---|
| CN | 102582933 | A | 7/2012 |
| CN | 103006440 | A | 4/2013 |
| CN | 204916556 | U | 12/2015 |
| CN | 205658728 | U | 10/2016 |
| JP | 2007176537 | A | 7/2007 |
| JP | 2016101951 | A | 6/2016 |
| JP | 2017-30791 | A | 2/2017 |
| JP | 2017030791 | A | 2/2017 |
| JP | 2017056952 | A | 3/2017 |
| JP | 6566556 | B2 | 8/2019 |
| WO | 2002026087 | A2 | 4/2002 |
| WO | 2015039400 | A1 | 3/2015 |

* cited by examiner

SIPPY CUP

CROSS-REFERENCE TO RELATED APPLICATIONS

This application is a continuation of U.S. application Ser. No. 16/614,941 filed Nov. 19, 2019, which is the U.S. National Phase of PCT Application No. PCT/IB2017/053532 filed on, Jun. 14, 2017, the disclosure of which is incorporated in its entirety by reference herein.

TECHNICAL FIELD

Drinking cups for children having a closed lid with incorporated straw to minimize liquid spills and leaks.

BACKGROUND

Sippy cups have become a widely used drinking vessel for serving liquids to infants and young children. Sippy cups have a vessel body holding a liquid, a removeable lid closing the mouth of the vessel and having a straw extending through the lid through which a child may drink the liquid. Typically, a cover is attached to the lid in order to cover and pinch off the straw to store the sippy cup when not in use. A variety of mechanisms have been deployed in the past in order to seal the sippy cup when the cover is in a closed position to minimize the liquid leaks. Similarly, various mechanisms have been deployed for venting the sippy cup when in use to enable to the liquid to be freely withdrawn through the straw by the user. There was a need for a simple vent mechanism which enables liquid to be freely withdrawn by the user and to equalize air pressure within the cup to prevent accidental spillage and squirting yet securely seal when the cover is closed when the cup is not in use to prevent leaks and spills.

SUMMARY

The present sippy cup employs a cup having an internal cavity on an open mouth which is enclosed by a removeable lid having an inlet-outlet opening. An elastic straw-vent assembly is provided which has an elastic body which sealingly engages the inlet-outlet opening formed in the lid. The straw-vent assembly further includes a flexible tubular straw having a fluid passageway extending therethrough and preferably a separate air passageway extending through the elastic body forming a vent opening. A cover is moveably mounted on top of the lid and shiftable between an open and closed position. The cover is provided with an inward surface which engages and seals closed the vent opening when the cover is in a closed position and disengages the vent opening when the cover is in the open position allowing the internal cavity to vent the atmosphere. When in the closed position the inside of the cover engages the straw folding the straw against the lid. The straw is pinched between a ridge on the inside of the cover and a ridge formed on the lid, sealing the fluid passageway extending through the straw. When the cover is in the open position the straw extends. The straw fluid passageway and the vent opening are unobstructed enabling the child to freely drink liquid from the cup through the straw. To prevent fluid from being discharged through the straw when the cover is initially opened, as a result of pressure build up in the cup, the vent opens, equalizing the pressure in the cup and the atmosphere, before the straw fluid passageway is opened.

Preferably the elastic straw-vent assembly is provided with an annular ring which surrounds the vent opening to sealingly engage a projection formed on the internal surface of the cover when the cover is in the closed position. When the cover is in the open position the projection moves away from the annular ring freeing the vent opening. Ideally the fluid passageway in the straw and the air passageway in the vent are each provided with a thin elastic membrane having a slit formed therein which limits liquids from leaking from the vessel when the vessel is tipped. Ideally the slit in the vent membrane opens at a pressure relative to the opening pressure of the straw membrane vent so that a buildup of pressure inside of the cup will not cause liquid to de discharged from the straw. Preferably the straw and vent membranes open at a pressure above the pressure exerted on the membrane when the sippy cup is inverted when full of water with the straw extended.

The preferred elastic straw-vent assembly is further provided with a pull tab which extends inwardly from the vessel when installed in the lid. The pull tab enables the user to grasp the straw-vent assembly and remove it easily from the lid for cleaning or replacement when damaged.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
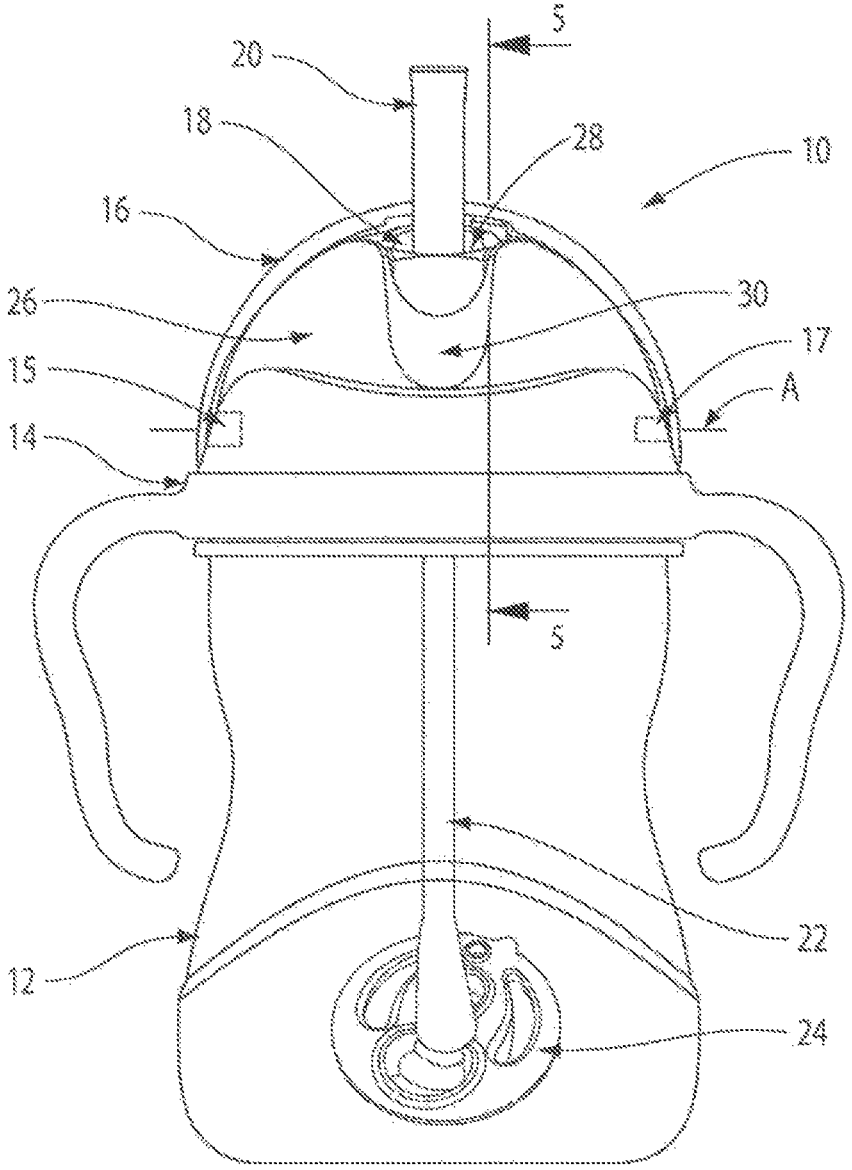
FIG. 1 is a front side elevational view of the sippy cup with the lid in the open position and the straw extended.
Figure 2:
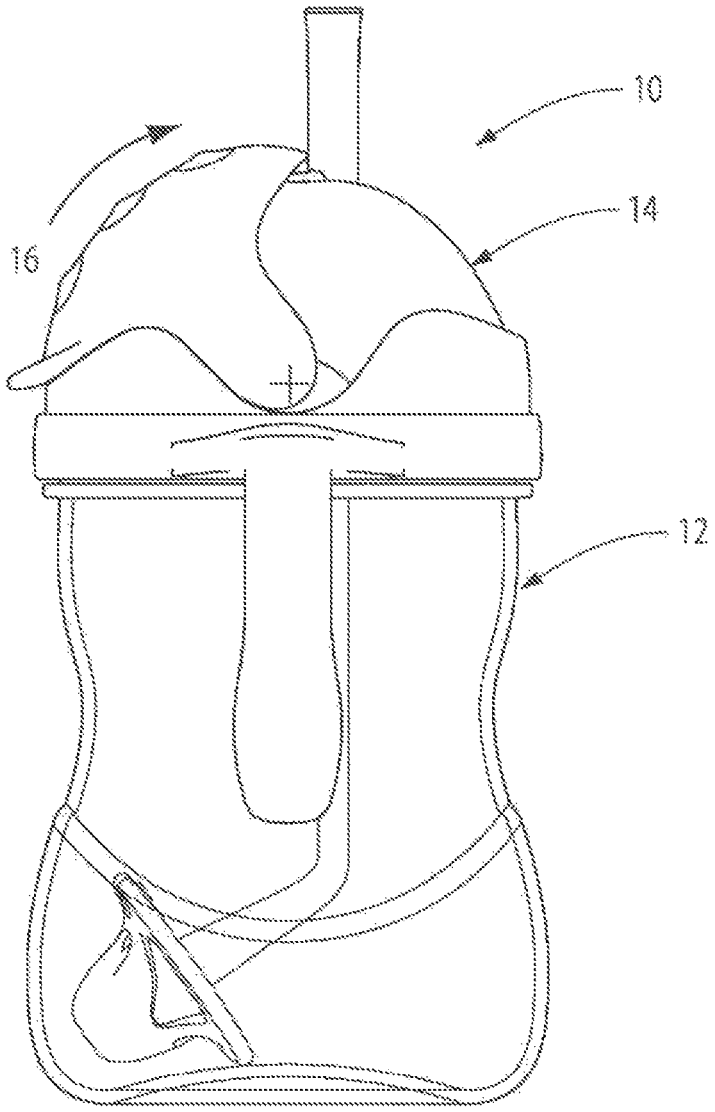
FIG. 2 is a left side elevational view of FIG. 1 illustrating the lid rotated to the open position.
Figure 3:
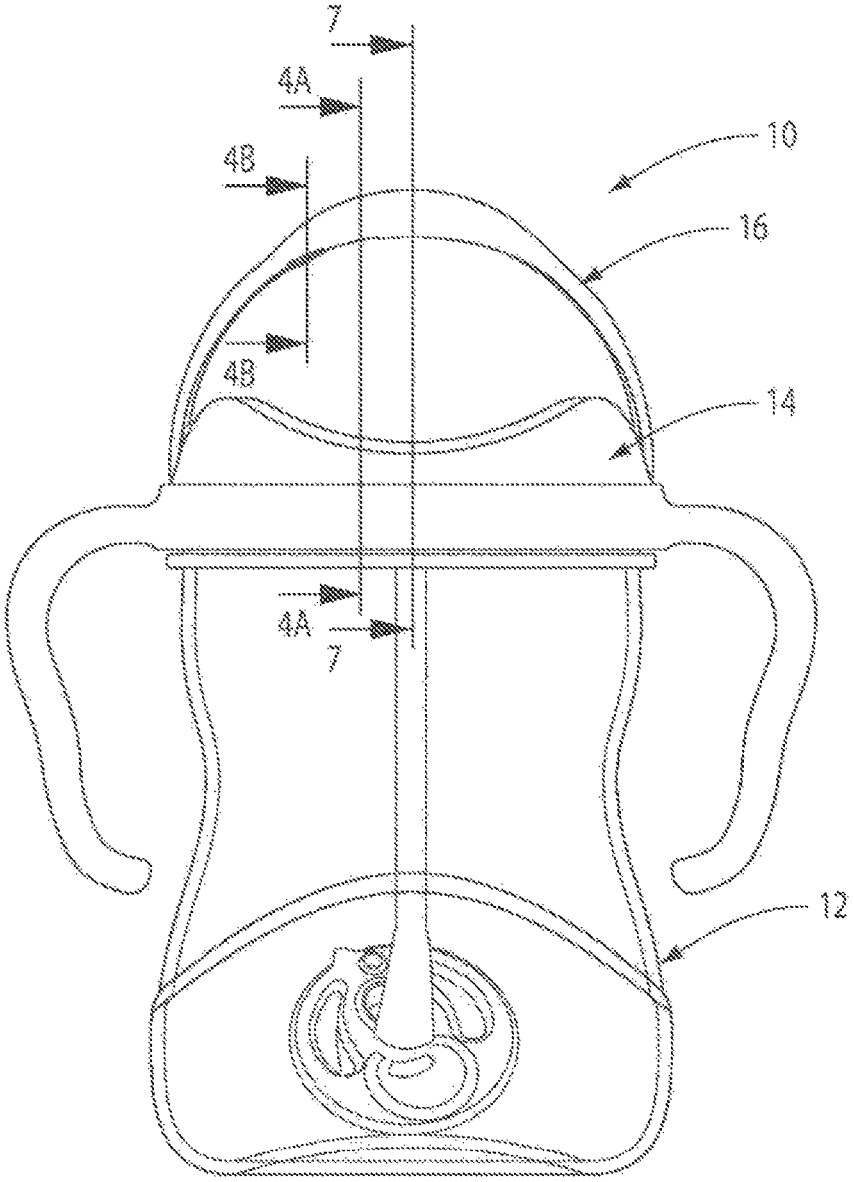
FIG. 3 is a rear side elevational view of the sippy cup of FIG. 1 with the lid rotated to the closed position.

The sippy cup 10 of the preferred embodiment is shown in FIGS. 1, 2 and 3 in the open and closed position. FIGS. 1 and 2 show the sippy cup in the open position. The sippy cup is made up of four main components, a cup 12 for holding a liquid and an internal cavity provided with an open mouth and a removable lid 14. The lid 14 is connected to the mouth of cup 12 by threaded connection, preferably an elastic O-ring 13 is provided to minimize leakage. A cover 16 is moveably mounted to the lid 14 for rotation about a transverse axis A. In the preferred embodiment cover 16 is pivotably mounted by a pair of pins 15 and 17 on the cover which project into matching bores in the lid 14. Preferably the pins 15 and 17 and their matching bores are of different diameters so that the cover 16 only attaches to the lid 14 in one orientation. In FIGS. 1 and 2 the cover 16 is shown in the open position exposing the elastic straw-vent assembly 18 and allowing the flexible tubular straw 20 to upwardly extend as illustrated. Preferably an elongate tube 22 having a weighted end 24 is connected to the flexible tubular straw 20 so that liquid may be withdrawn from the cup in both the normal position shown as well as an inverted position.

In the preferred embodiment, cup 12 is preferably made of a clear or transparent plastic while the lid 14 and cover 16 may be made of a brightly colored plastic material. Preferably the lid 14 has a generally semi-circle shaped dome 26 having a central inlet-outlet opening 28 into which the elastic straw-vent assembly 18 is inserted with the recessed groove 30 aligned generally perpendicular to axis A in top plan view. The cover 16 may rotate about axis A in the direction of the arrow shown in FIG. 2. The cover 16 is in the shape of a segment of a semi-circle shell generally following the contour of the semi-circle dome 26. When the cover 16 rotates to the closed position shown in FIG. 3, the flexible tubular straw 18 folds into a groove 30 and is pinched closed preventing liquid from leaking from the straw when the container is tipped.

Figure 4A:
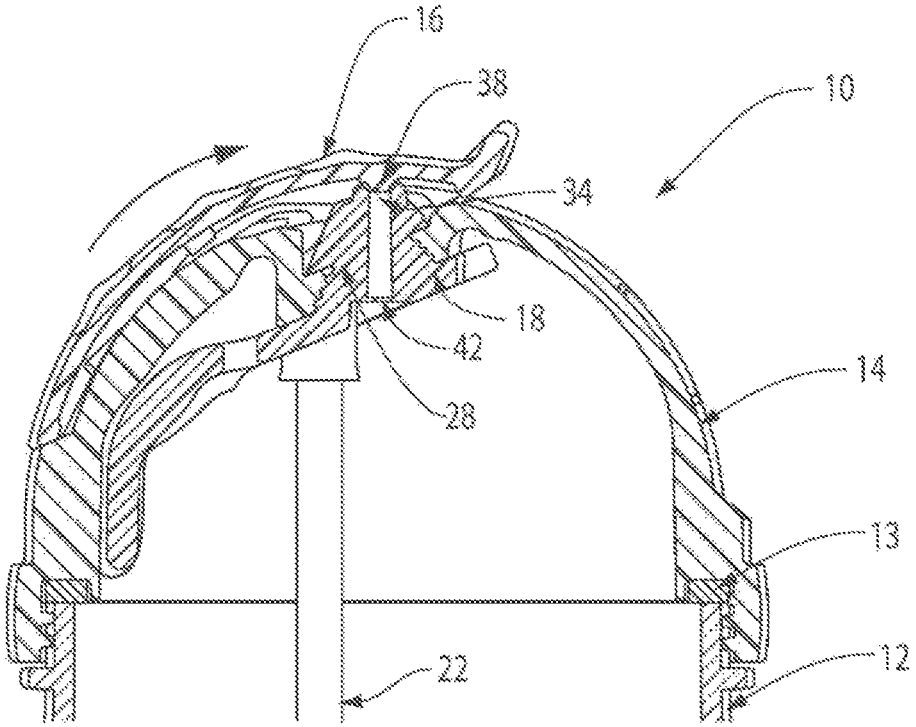
FIG. 4A is a section view taken along line 4A-4A of FIG. 3 showing the cover in the closed position closing the vent.
Figure 4B:
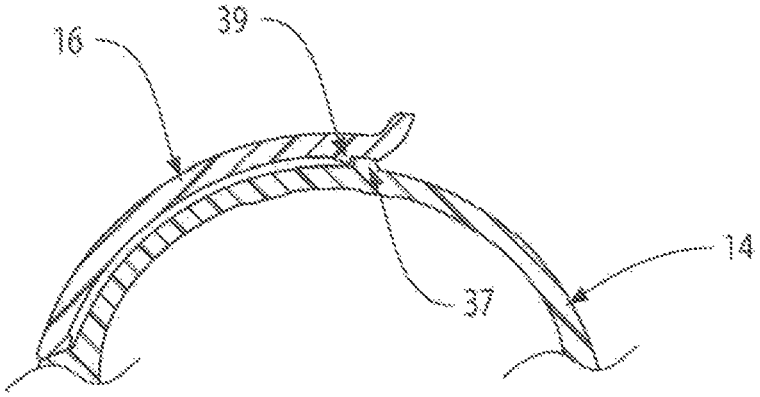
FIG. 4B is a section view taken along line 4B-4B of FIG. 3 showing a optional detent mechanism.

FIG. 4A is an enlarged partial cross-sectional view taken along line 4A-4A in FIG. 3. Cover 16 is in the closed position with the flexible tubular straw 18 folded into groove 30 which is formed in the dome 26 of cover 16. The elastic straw-vent assembly 18 is provided with an air passage extending therethrough providing a vent. The external end of the air passage 32 forms a vent opening 34 which is surrounded by an annular vent ring 36. When cover 16 is in the open position shown in FIG. 5, vent opening 34 is open to atmosphere. When the cover 16 is moved to the closed position, shown in FIG. 4, a projection 38 formed on the inside surface of cover 16 aligns with vent ring 36 which elastically deforms and securely seals off vent opening 34. The vent ring 36 forms a mound shaped protrusion which extends about the vent opening 34 cooperates with the projection on the cover to provide a detent mechanism releasably holding the cover 16 in the closed position. Optionally a supplemental detent is provided by a pair of cooperating bumps 37 and 39 formed on lid 14 and cover 16 as shown in FIG. 4B, an enlarged partial cross-sectional view taken along line 4B-4B in FIG. 3.

The inner end of air passage 32 opens into the internal cavity 40 collectively defined by the cup 12 and the lid 14. The inner end of the air cavity 32 is provided with a thin membrane 42 having a small slit formed therein. The thin membrane and slit serve to normally seal the air passage closed in the event that the container is tipped and the inner end of the air passage 32 is exposed to liquid. The vent membrane 42 will eliminate or reduce leakage. A pressure differential across the membrane of greater than about 6 inches of water will cause the slit in the vent membrane 42 to open allowing air to be drawn into the internal cavity 40 as the liquid in the container is withdrawn by the user through the straw 20. Straw 20 similarly has a thin membrane 44 formed therein with a similar slit which opens in response to a pressure differential. Straw membrane 44 prevents liquid within the straw and tube 22 from dripping from the straw 20 if the sippy cup is inverted with the cover 16 open and straw 20 extended. Preferably the straw membrane 44 is located adjacent the free end of straw 20 and has a convex inwardly projecting shape. The straw membrane is configured to prevent the opening of the slit in an outward flow direction at pressures less than 6 inches of water to limit liquid from leaking when the vessel is inverted. In a larger vessel the vent open pressure will be higher so that the vessel when full will not leak when inverted with the straw extended.

Figure 5:
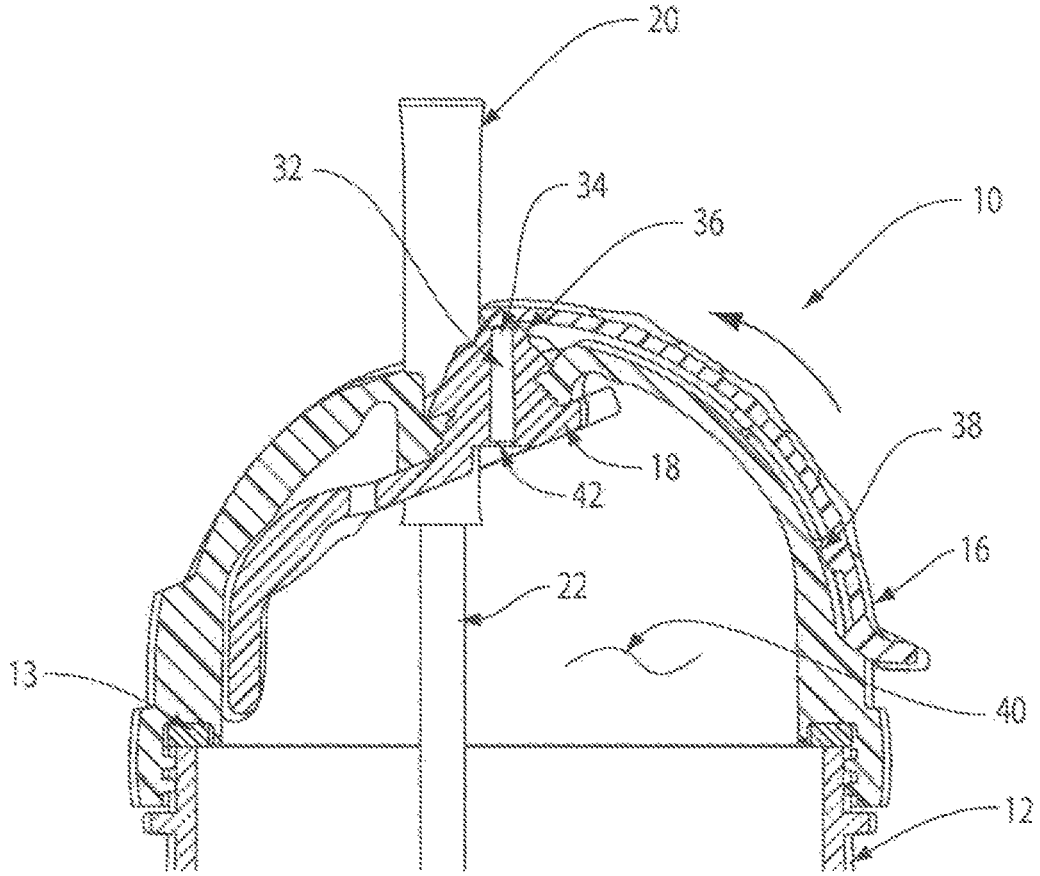
FIG. 5 corresponds to FIG. 4 with the cover moved to the open position with the straw extended.

When in use, cover 16 is in the open position shown in FIG. 5 and straw 20 is extended. If the sippy cup is exposed to heat, from sunlight or a warm room, the air within the internal cavity 40 will expand. To prevent this air pressure from pushing liquid out through the straw 20 the vent membrane 42 opens before straw membrane 44 venting the internal cavity 40 to atmosphere. Vent membrane 42 opens at a pressure which is sufficiently low relative to opening pressure of the straw membrane 44 to prevent liquid from being displaced through the straw due to pressure in the internal cavity.

Figure 6:
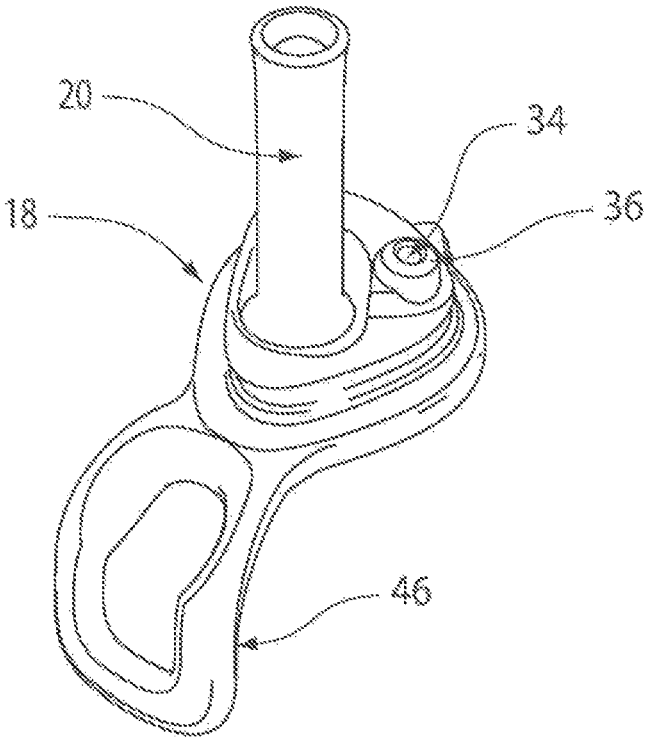
FIG. 6 is a perspective view of the elastic straw-vent assembly showing a pull tab and the annular bent ring in more details.

Straw-vent assembly 18 is shown in perspective view in FIG. 6 with a tube 22 and a weighted end 24 removed. In this view vent ring 36 is shown surrounding vent opening 34. The shape of tab 46 is also illustrated. Preferably tab 46 is in the form of a ring which can be easily grasped by a user, enabling the user to pull the straw-vent assembly 18 out of the lid so that it can be independently cleaned or replaced if damaged. The elastic body of straw-vent assembly 18 is made of polymer having a durometer of Shore A 30-70, preferably about Shore A 50.

Figure 7:
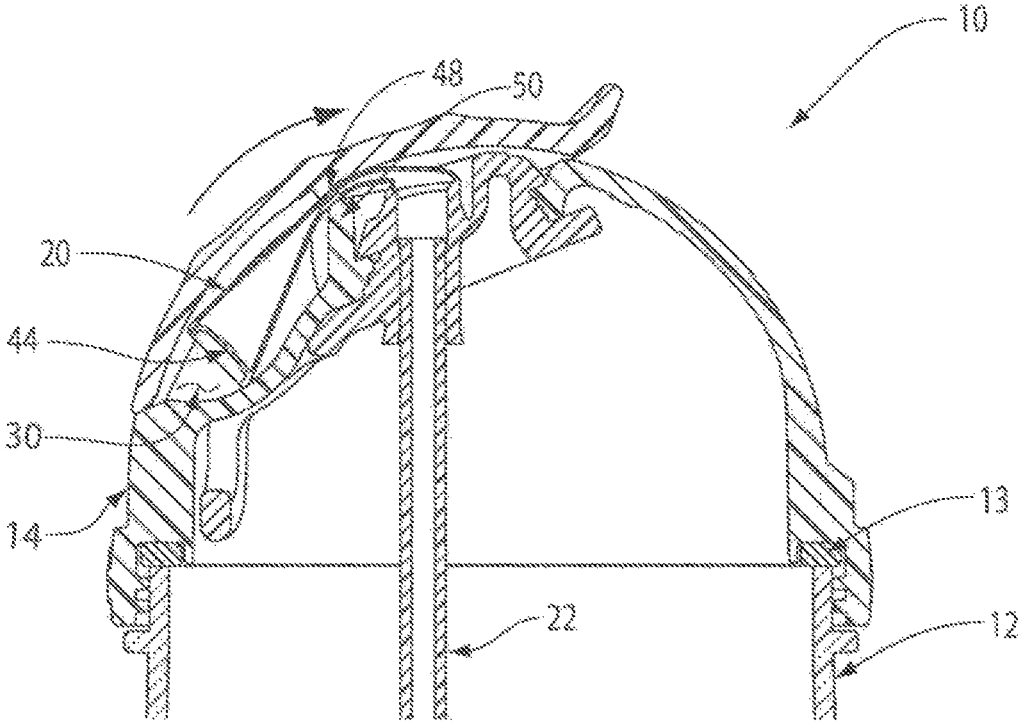
FIG. 7 is a section view taken along line 7-7 of FIG. 3 showing the cover and a flexible straw in the closed position with the straw internal passageway pinched closed.

FIG. 7 is a section view taken along line 7-7 of FIG. 3 showing the cover fully closed. In this position, the flexible straw is folded over and pinched between a ridge 48 formed on the cover 16 and a ridge 50 formed on the lid 14 adjacent the upper end of groove 30. In the closed position the straw internal passageway is pinched closed.

Figure 8:
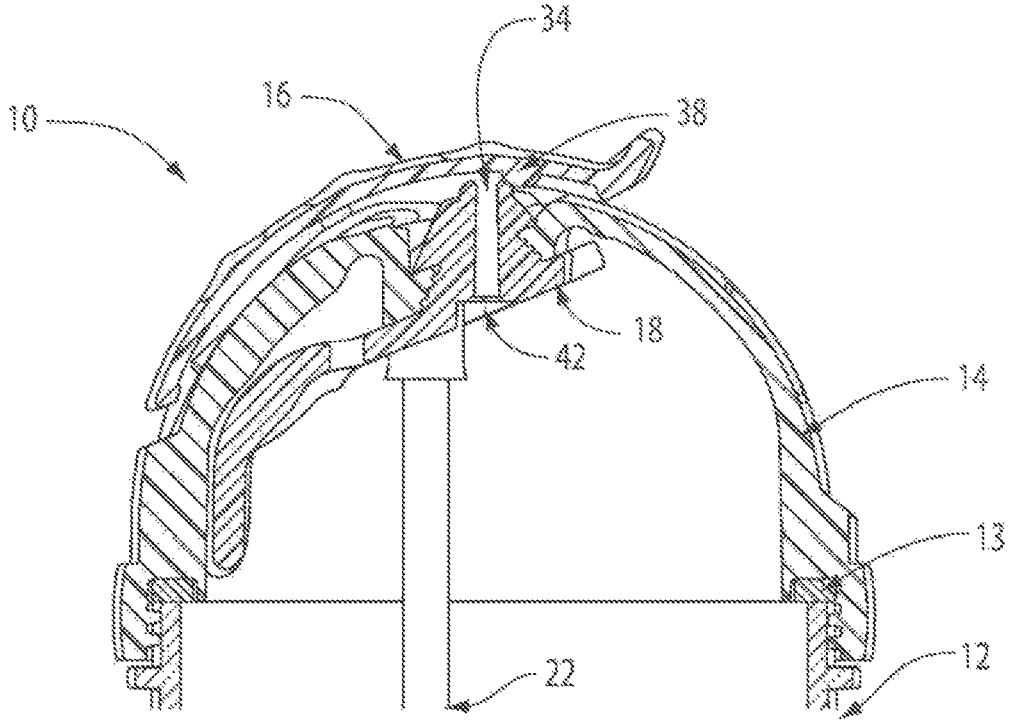
FIG. 8 corresponds to the FIG. 4 section view with the cover initially moved to a position where the vent opens while the straw is still pinched closed.
Figure 9:
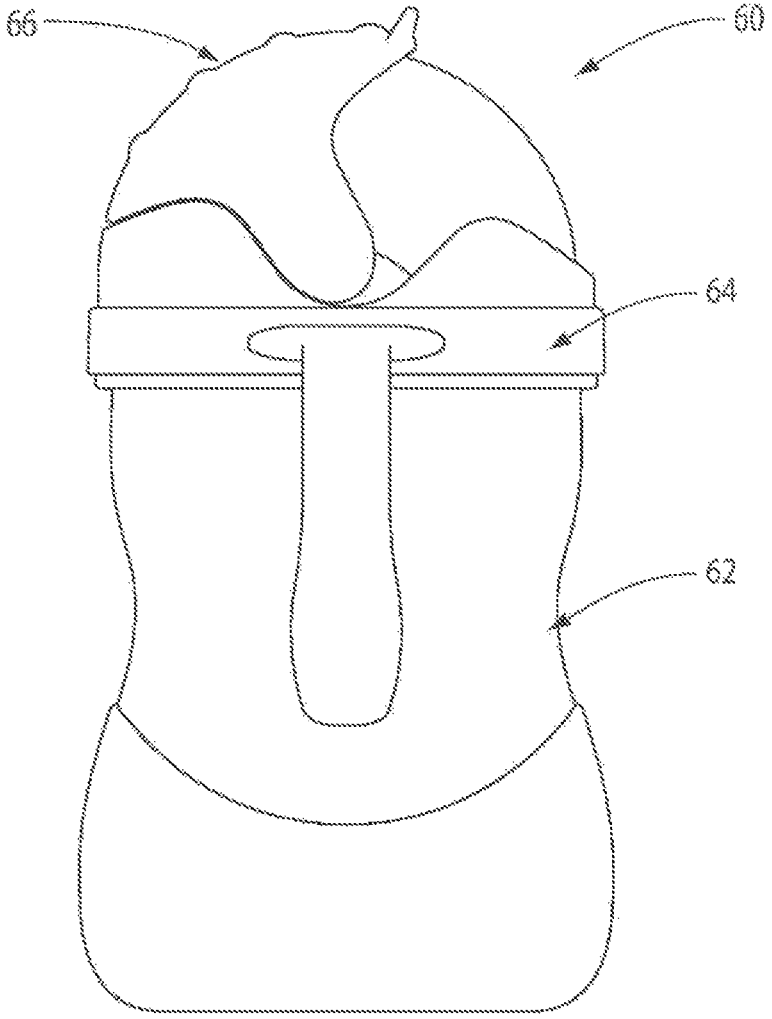
FIG. 9 is a side elevation of an alternative sippy cup embodiment.
Figure 10:
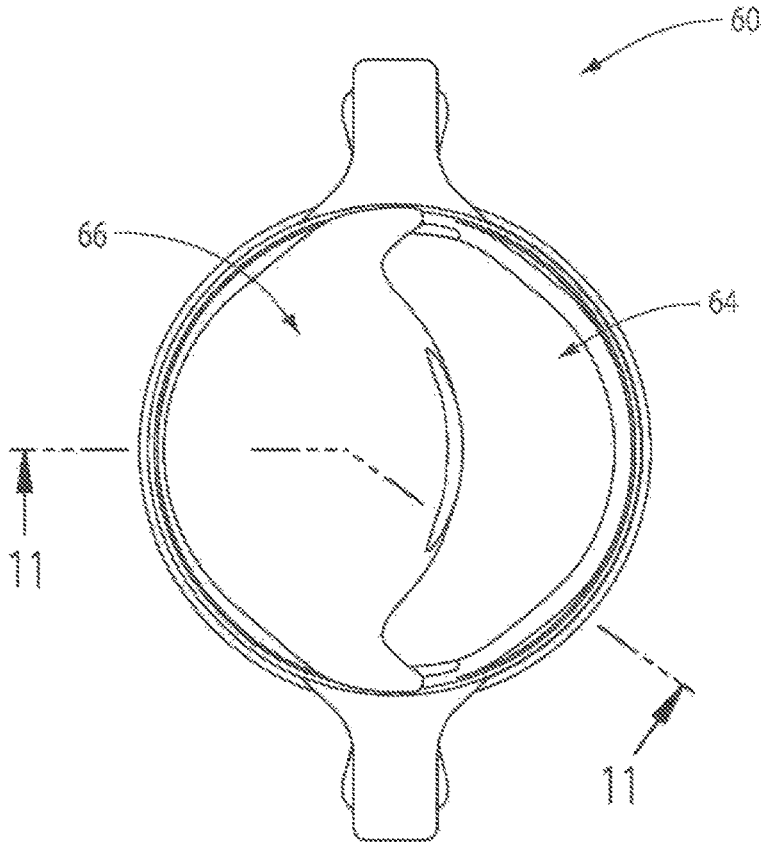
FIG. 10 is a top plan view of the sippy cup of FIG. 9.

To prevent fluid from being discharged through the straw 20 as a result of pressure build up in the cup when the cover 16 is initially opened as shown in FIG. 8, the vent 34 opens first, equalizing the pressure between the cup cavity 32 and the atmosphere, while the straw fluid passageway remains closed. This feature is particularly beneficial when a partially full sippy cup is heated by the sun with the cover closed. Releasing the internal pressure before unpinching the straw prevents fluid from being squirted out as the cover is opened.

In the preferred embodiment illustrated in FIGS. 1-4 the straw-vent assembly 18 combines the straw and the vent into a single integral unit. Alternatively, the straw and the air vent can be formed as separate elements each formed of an elastic material and mounted in two separate inlet-outlet openings in the lid. However, the combined straw-vent assembly with integral tab is preferred for ease of use.

Figure 11:
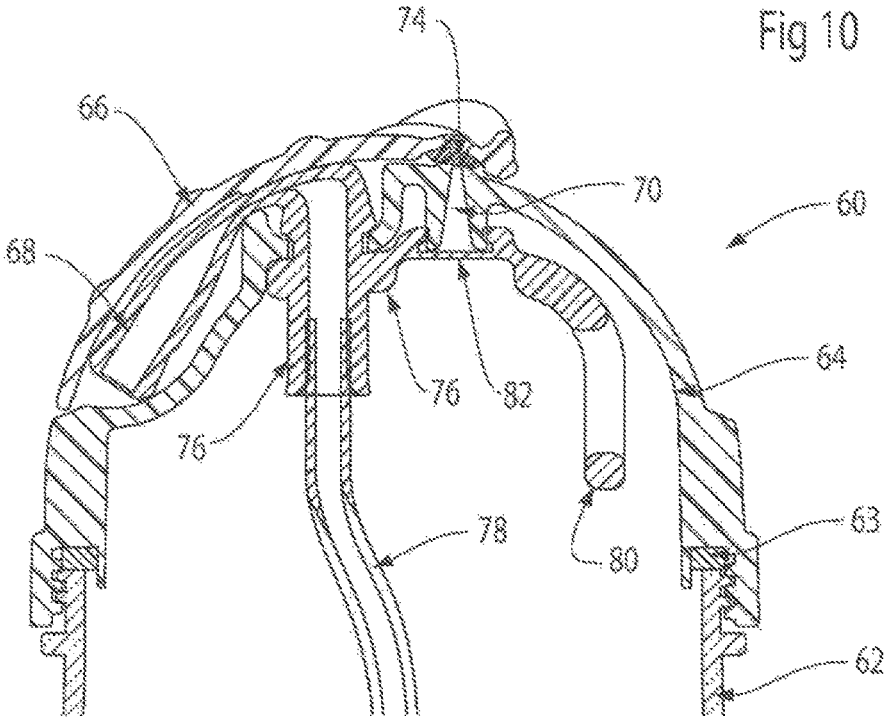
FIG. 11 is a section view taken along line 11-11 of FIG. 10 showing the cover in the closed position with the vent sealed closed and the straw pinched between the cover and the lid.
Figure 12:
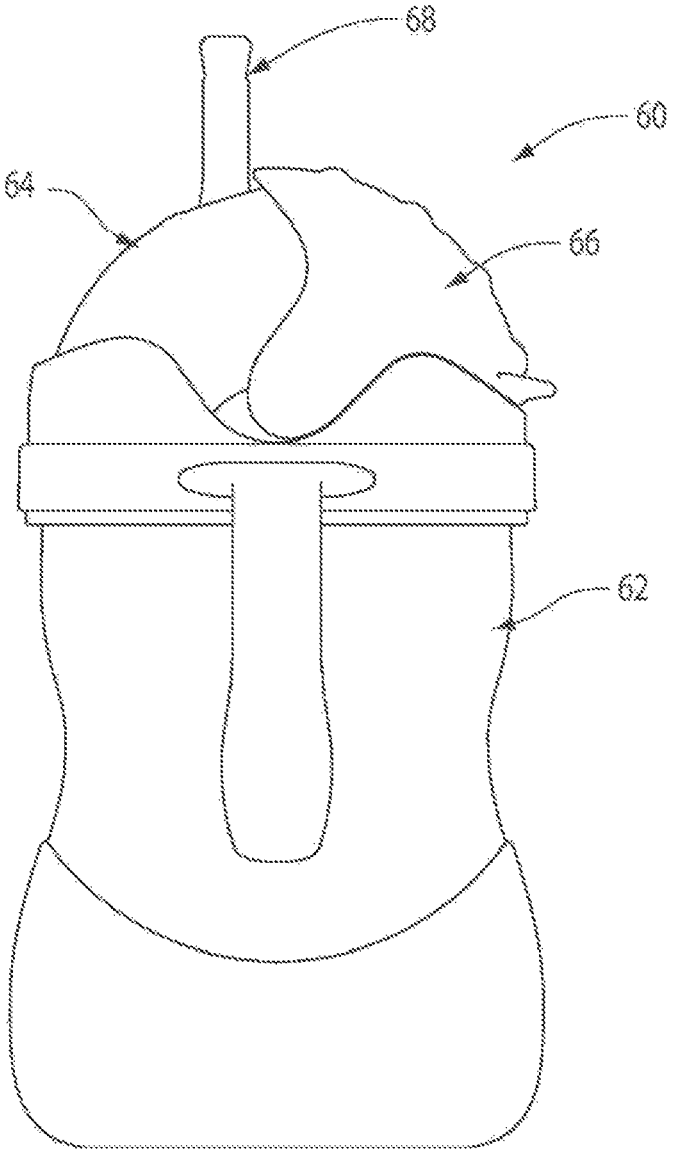
FIG. 12 is a side elevation of an alternative sippy cup embodiment with the cover open and the straw extended.
Figure 13:
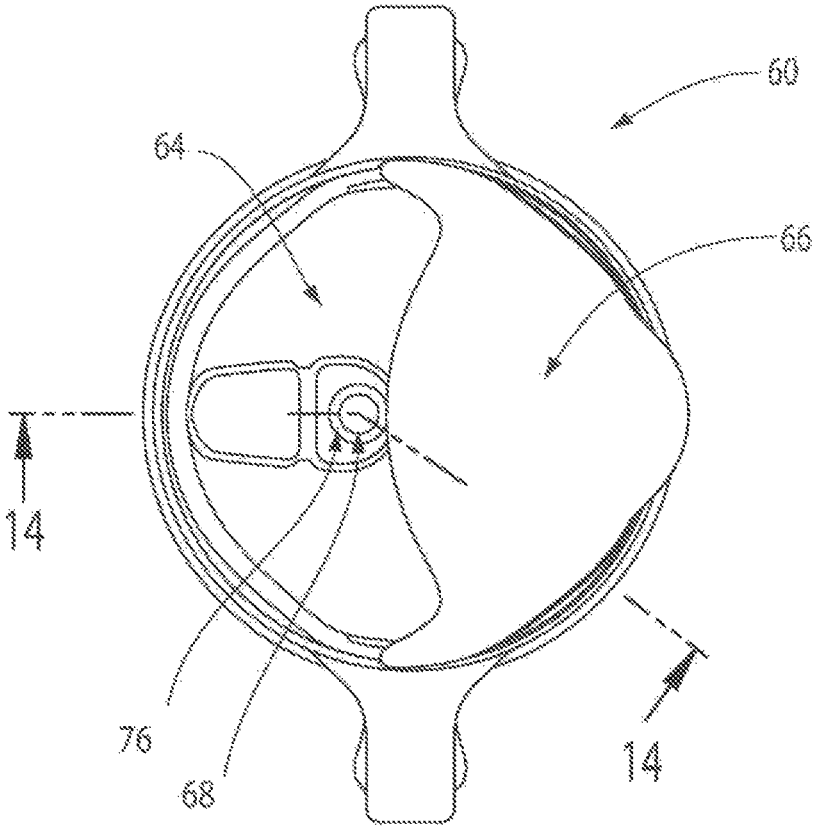
FIG. 13 is a top plan view of the sippy cup of FIG. 12.
Figure 14:
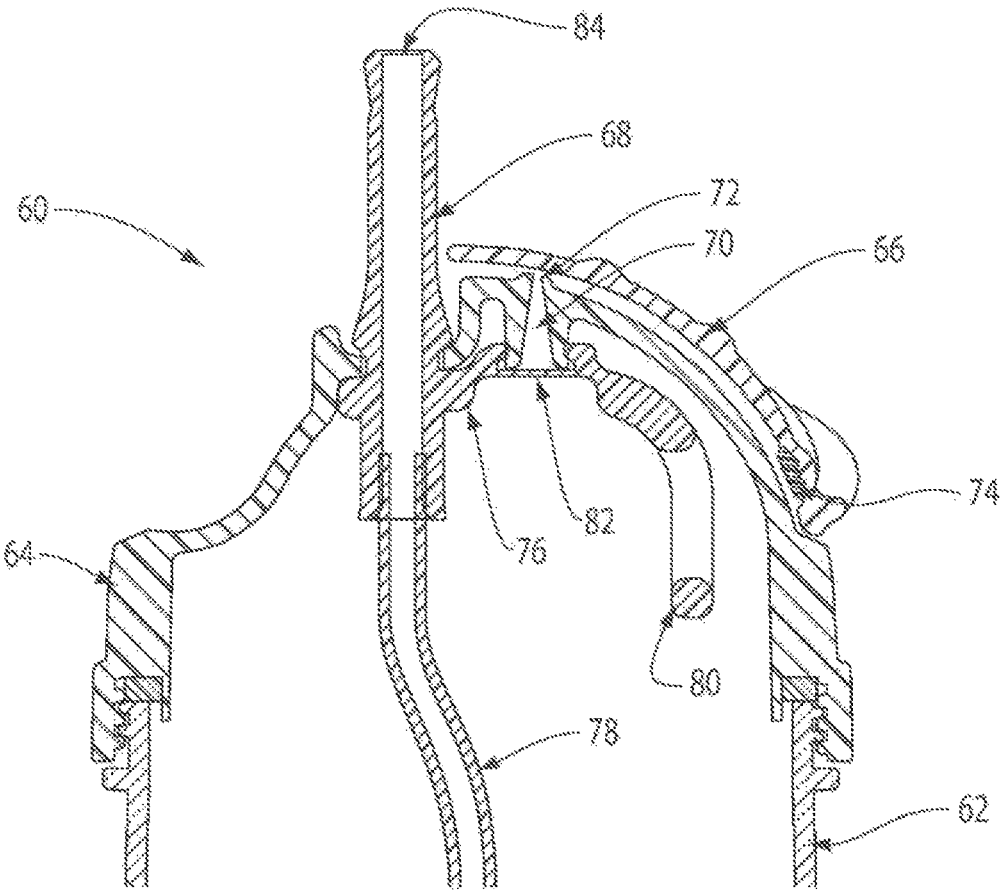
FIG. 14 is a section view taken along line 14-14 of FIG. 13 showing the cover in the open position with the vent open and the straw extended.

An alternate sippy cup embodiment 60 is shown in FIGS. 9-14. Sippy cup 60 like sippy cup 10 has a cup 62, an O-ring 63, a lid 64, a cover 66 and a flexible straw 68. In the alternative embodiment the vent passageway 70 is formed in the lid 64 as illustrated in FIG. 11. A raised vent ring 72 surrounds the external end of the vent passageway 70 and is sealed closed by an elastic projection 74 formed on the cover 66. The elastic projection 74 is preferably co-molded to the more rigid plastic material forming the cover 66.

The straw 68, similar to straw-vent assembly 18, is formed as part of a relatively soft elastic material forming a body 76 that tightly fits in to a central opining in lid 64. The portion of the body 76 extending inside of the lid 64 is connected to a fluid pickup tube 78. The body 76 also forms a tab 80 and a vent membrane 82. The vent membrane 82 cooperates with vent passageway 70 which is formed in the lid 64 to function similar to vent membrane 42 in the earlier embodiment 10. A straw membrane 84 is formed in flexible straw 68 adjacent the free end to prevent liquid leakage when the sippy cup is tipped or inverted in a similar manor to straw membrane 44 in the first embodiment.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A drinking vessel, comprising:

a cup having an open mouth and an internal cavity;

a removable lid attachable to the cup mouth, the lid having an inlet-outlet opening;

an elastic straw-vent assembly having an elastic body sealingly engaging the inlet-outlet opening, a flexible tubular straw having a fluid passageway extending through the elastic body, and an air passageway forming a vent opening; and a cover movably mounted on top of the lid, shiftable between a closed position and an open position, with an inward surface of the cover, when in the closed position, forming a fluid tight seal with the vent opening and pinching the flexible tubular straw against the lid closing the fluid passageway;

wherein, when opening the cover from the closed position, the cover disengages the vent opening before un-pinching and unfolding the straw, wherein, when the cover is in the opening position, with straw available to drink from, the vent opening is unobstructed by the cover.

2. The drinking vessel of claim 1, wherein the elastic straw-vent assembly further comprises an annular vent ring which surrounds the vent opening which sealingly engages a projection formed on an internal surface of the cover when in the closed position.

3. The drinking vessel of claim 1, wherein the elastic straw-vent assembly further comprises a thin straw membrane within the straw fluid passageway having a slit which limits liquid from leaking when the vessel is tipped.

4. The drinking vessel of claim 3, wherein the straw membrane has a convexly shaped inwardly projecting shape preventing the opening of the slit in an outward flow direction at when the vessel full of water is inverted with the straw extended.

5. The drinking vessel of claim 1, wherein the vent in the elastic straw-vent assembly further comprises a vent membrane within the air passageway that is thin forming the vent having a slit which limits liquid from leaking out of the vessel when tipped.

6. The drinking vessel of claim 5, wherein the slit in the vent membrane opens in an outward flow direction at a pressure greater than the pressure exerted on the vent membrane when the sippy cup full of water is inverted.

7. The drinking vessel of claim 5 wherein, when the cover is in the open position and the internal cavity is pressurized, the vent membrane opens at a lower pressure relative to an opening pressure of the straw membrane to prevent liquid from being displaced through the straw due to pressure in the internal cavity.

8. The drinking vessel of claim 1, wherein the elastic straw-vent assembly is made of polymer having a durometer of Shore A 30-70.

9. The drinking vessel of claim 1 wherein the cover is pivotably mounted by a pair of pins on the cover which project into matching bores in the lid, the pins and their matching bores being of different diameters so that the cover only attaches to the lid in one orientation.

10. The drinking vessel of claim 1 wherein the elastic straw-vent assembly further comprises a pull tab extending inwardly into the vessel when installed on the lid which can be grasped by a user enabling the elastic straw-vent assembly to be detached from the lid.

11. A drinking vessel, comprising:

a cup having an open mouth and an internal cavity;

a removable lid attachable to the cup mouth, the lid having an inlet-outlet opening and an air vent opening;

an elastic straw assembly having an elastic body sealingly engaging the inlet-outlet opening, a vent membrane having a slit cooperating with the air vent opening in the removable lid, a flexible tubular straw having a fluid passageway extending through the elastic body and a straw membrane provided within the fluid passageway within a slit therein to resist the flow of liquid; and a cover movably mounted on top of the lid, shiftable between a closed position and an open position, with an elastic projection on an inward surface of the cover forming fluid tight seal with the vent opening when the cover is in the closed position;

wherein, in the closed position the cover engages the straw, folding the straw against the lid to seal the straw passageway, and in the open position, the straw fluid passageway and the air vent opening are unobstructed by the cover;

wherein the air vent further comprises an annular vent ring which surrounds the vent operating which sealingly engages a projection formed on an internal surface of the cover when the cover is in the closed position providing a detent mechanism holding the cover in the closed position.

12. The drinking vessel of claim 11 wherein when the cover is in the open position, the vent membrane opens at a pressure which is sufficiently low relative to opening pressure of the straw membrane to prevent liquid from being displaced through the straw due to pressure in the internal cavity.

13. The drinking vessel of claim 11, wherein elastic straw assembly is further provided with a tab portion forming a handle extending into the internal cavity enabling the elastic straw assembly to be grasped and removed from the lid for cleaning or replacement.

14. The drinking vessel of claim 11, wherein, the inward surface of the cover is configured so that when opening the cover from the closed position, the cover unseals the vent opening before un-pinching and unfolding the straw.

15. The drinking vessel of claim 11, wherein the vent opening is unobstructed by the cover when cover is in the open position.

* * * * *